US006320364B1

(12) United States Patent
Tateishi et al.

(10) Patent No.: US 6,320,364 B1
(45) Date of Patent: Nov. 20, 2001

(54) CURRENT SOURCE CIRCUIT

(75) Inventors: Tetsuo Tateishi; Katsutomi Harada, both of Aichi-ken (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/671,091

(22) Filed: Sep. 27, 2000

(30) Foreign Application Priority Data

Oct. 1, 1999 (JP) ..... 11-281205

(51) Int. Cl.[7] ..... G05F 3/24
(52) U.S. Cl. ..... 323/315; 323/316
(58) Field of Search ..... 323/312, 313, 323/314, 315, 316

(56) References Cited

U.S. PATENT DOCUMENTS 4,004,247 * 1/1977 Van de Plassche ..... 323/315
4,897,596 * 1/1990 Hughes et al. ..... 323/315
5,021,730 6/1991 Smith ..... 323/316
5,045,773 * 9/1991 Westwick et al. ..... 323/316
5,173,656 * 12/1992 Seevinck et al. ..... 323/314
5,446,397 * 8/1995 Yotsuyanagi ..... 327/66
5,446,409 * 8/1995 Katakura ..... 327/538
5,539,302 * 7/1996 Takimoto et al. ..... 323/315
5,774,021 * 6/1998 Szepesi et al. ..... 330/257

* cited by examiner

*Primary Examiner*—Adolf Deneke Berhane
(74) *Attorney, Agent, or Firm*—Woodcock Washburn Kurtz Mackiewicz & Norris LLP

(57) ABSTRACT

A start signal is supplied to MOS transistor Q8, MOS transistor Q8 is turned on, the first current mirror circuit is driven, and the same mirror current flows in MOS transistors Q4–Q7. Then, of two MOS transistors Q8 and Q9 that compose the second current mirror circuit, to MOS transistor Q8 is connected a resistor R2 and to MOS transistor Q9 is supplied a reference signal (Vref). According to such a configuration, reference current (Iref) that is generated in resistor R2 becomes current corresponding to the reference signal (Vref), and thereby output current (Iout) is outputted from MOS transistor Q7 based on this reference current (Iref).

5 Claims, 3 Drawing Sheets

CURRENT SOURCE CIRCUIT

BACKGROUND OF THE INVENTION

1. Field of the Invention

The present invention relates to a current source circuit using current mirror circuits.

2. Description of the Prior Art

Today a current source circuit using current mirror circuits is proposed. FIG. 1 is the circuit diagram of a current source circuit using current mirror circuits. In FIG. 1, a current source circuit 1 is comprised of an operational amplifier 2, an N-channel MOSFET (hereinafter simply called a "MOS transistor") Q1, P-channel MOSFETs (hereinafter simply called a "MOS transistor") Q2 and Q3 that compose a current mirror circuit and a resistor R1.

A reference signal (Vref), which is described later, is supplied to the non-inversion input (positive input) of the operational amplifier 2, and a feedback signal is applied to the inversion input (negative input). The feedback signal applied to the inversion input (negative input) is a voltage value at point A shown in FIG. 1, and which is a potential of the connection point between the MOS transistor Q1 and the resistor R1. The output of the operational amplifier 2 is supplied to the gate of the MOS transistor Q1 and the output turns the MOS transistor Q1 on/off.

The MOS transistors Q2 and Q3, which compose the current mirror circuit, have the same characteristics and the same mirror current flows in the MOS transistors Q2 and Q3. For example, when a gate voltage is applied to the gate of the MOS transistor Q1 from the operational amplifier 2, the MOS transistor Q1 is turned on, a current flows in the MOS transistor Q2. Simultaneously, an output current (mirror current) Iout with the same current value flows in the MOS transistor Q3.

The potential at point A is the potential of the reference signal (Vref) of the operational amplifier 2. Therefore, while the MOS transistor Q1 is turned on, the voltage applied to the resistor R1 is Vref and the current (Iref) that flows in the resistor R1 is the voltage of the reference signal (Vref) divided by the resistance value of the resistor R1. This current Iref flows in one direction in the current mirror circuit, and the output current (mirror current) (Iout) shown in FIG. 1 is the same as the current (Iref).

Therefore, when in the configuration it is assumed that the reference signal varies, the output current (mirror current) also varies in the same way. For example, when a triangular wave is used for the reference signal (Vref), the output current (mirror current) Iout becomes a triangular wave.

In this way, according to the current source circuit shown in FIG. 1, the output current varies as the reference signal (Vref) varies and the desired output current can be obtained. However, in the current source circuit, the response speed is slow, which is a problem. This is because the operational amplifier 2 is used and the feedback circuit is used at the same time. Specifically, many transistor circuits are used in the operational amplifiers and it takes much time to drive the circuit. The use of the feedback circuit requires a period of time to return the signal.

FIG. 2 shows that the output current (mirror current) Iout delays from the reference signal (Vref) In FIG. 2, a waveform represented by Vref is the reference signal inputted to the operational amplifier 2, and a dotted waveform represented by Iout indicates the output timing of the output current (mirror current) The output current (mirror current) Iout delays from the reference signal (Vref), and a time lag of time T is generated between the reference signal (Vref) and the output current (mirror circuit) Iout.

This time lag is a problem when the output current (mirror current) Iout is actually used. For example, when the output current (mirror current) Iout is used as an oscillator modulation, the modulation timing is delayed. When a pulse signal is generated using the output current (mirror current) Iout, the pulse signal with a targeted timing cannot be generated due to the delay of the output current (mirror current).

SUMMARY OF THE INVENTION

It is an object of the present invention to provide a current source circuit using current mirror circuits in which the delay of an output current (mirror current) Iout against a reference signal (Vref) is eliminated.

Specifically, it is an object of the present invention to provide a current source circuit that comprises a first current mirror circuit for supplying an output current outside, a second current mirror circuits for driving the first current mirror circuit to which a resistor for generating a reference current corresponding to the output current is connected, a reference voltage supply circuit for setting the reference current that flows in the resistor and a third current mirror circuit for avoiding the influence of the mirror current that flows in the first and second current mirror circuits. The current source circuit needs a start signal which drives the first or second current mirror circuit. When the start signal is applied to the first or second current mirror circuit, a mirror current is generated. After that, the mirror current drives another current mirror circuit. Then, the mirror current corresponding to the reference voltage is also generated in the resistor by connecting the current outputting MOS transistor to the resistor and supplying the reference voltage to the diode connected MOS transistor. Furthermore, the output current (Iout), which is mirror current corresponding to the reference current, is outputted by the first current mirror circuit. Furthermore, current is prevented from flowing in the reference voltage supply circuit by driving the third current mirror circuit.

DESCRIPTION OF THE PREFERRED EMBODIMENT

The preferred embodiment of the present invention is described in detail below with reference to the drawings.

Figure 3:
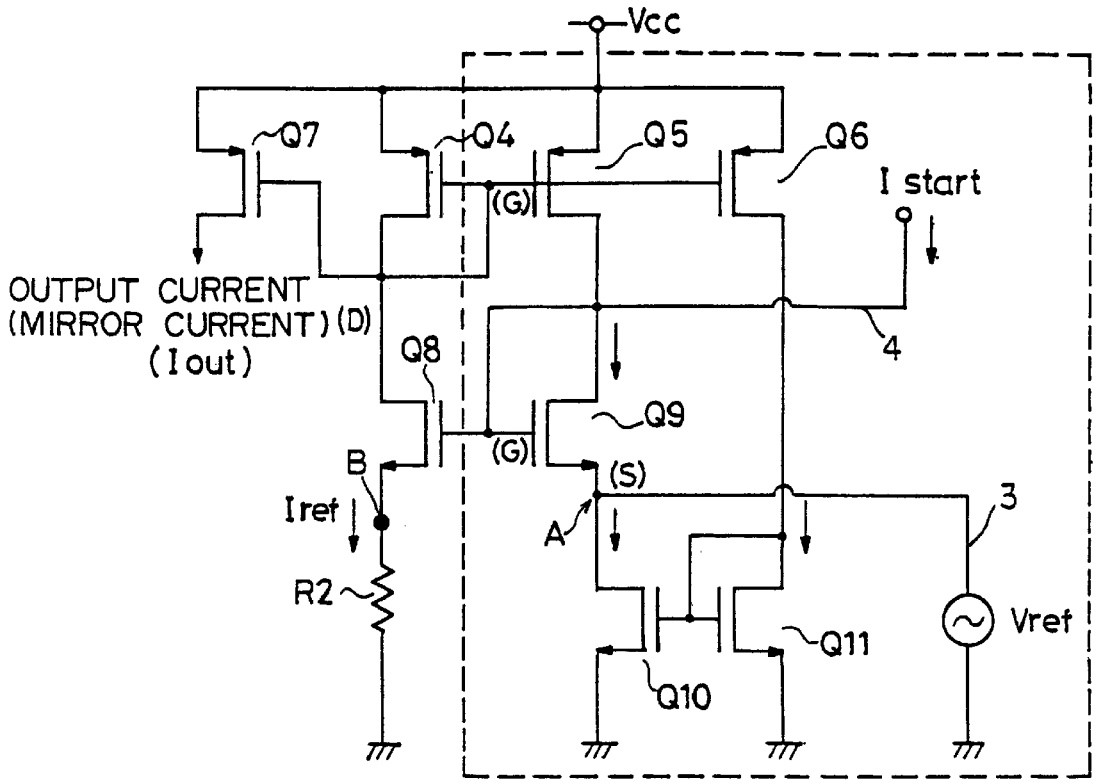
FIG. 3 is a circuit diagram of a current source circuit of the preferred embodiment.

FIG. 3 is a circuit diagram of a current source circuit of a preferred embodiment. In FIG. 3, this circuit comprises a plurality of MOS transistors Q4–Q7 that compose a first current mirror circuit, a plurality of MOS transistors Q8 and Q9 that compose a second current mirror circuit, a plurality of MOS transistors Q10 and Q11 that compose a third current mirror circuit, a resistor R2, a reference signal (Vref) supply circuit 3 and a start signal supply terminal 4. The MOS transistors Q4–Q7 have the same characteristics and the MOS transistors Q8–Q11 have the same characteristics.

A power supply Vcc is connected to the MOS transistors Q4–Q7, and the MOS transistors are supplied with current from the power supply Vcc. The gates (G) of the MOS transistors Q4–Q7 are connected to a drain (D) of the MOS transistor Q8, and the MOS transistors Q4–Q7 that compose the first current mirror circuit are simultaneously turned on by turning the MOS transistor Q8 on.

The MOS transistor Q9 that composes the second current mirror circuit together with the MOS transistor Q8 is connected to the MOS transistor Q5 in series, and mirror current that flows in the MOS transistor Q5 also flows in the MOS transistor Q9. The MOS transistor Q10 is also connected to the MOS transistor Q9 in series, and the mirror current that flows in the MOS transistor Q9 also flows in the MOS transistor Q10.

The MOS transistor Q11 that composes the third current mirror circuit together with the MOS transistor Q10 is connected to the MOS transistor Q6 in series, and mirror current that flows in the MOS transistor Q6 also flows in the MOS transistor Q11 without modification.

The resistor R2 is used to generate reference current (Iref) and plays the same role as the resistor R1 described above in FIG. 1. The output (output current (mirror current) Iout) of this current source circuit is mirror current outputted from the first current mirror circuit and the mirror current is outputted from the MOS transistor Q7.

In order to generate reference current (Iref) in the resistor R2, a reference signal (Vref) is supplied to the source (S) of the MOS transistor Q9. This reference signal (Vref) is outputted from a reference signal (Vref) supply circuit 3, which is, for example, a triangular wave, or a sine wave.

Furthermore, in this example, a start signal (Istart) is supplied to the gates (G) of the MOS transistors Q8 and Q9. This start signal (Istart) is inputted from the start signal supply circuit terminal 4 only start timing and the supply of the start signal is stopped after that time.

Figure 1:
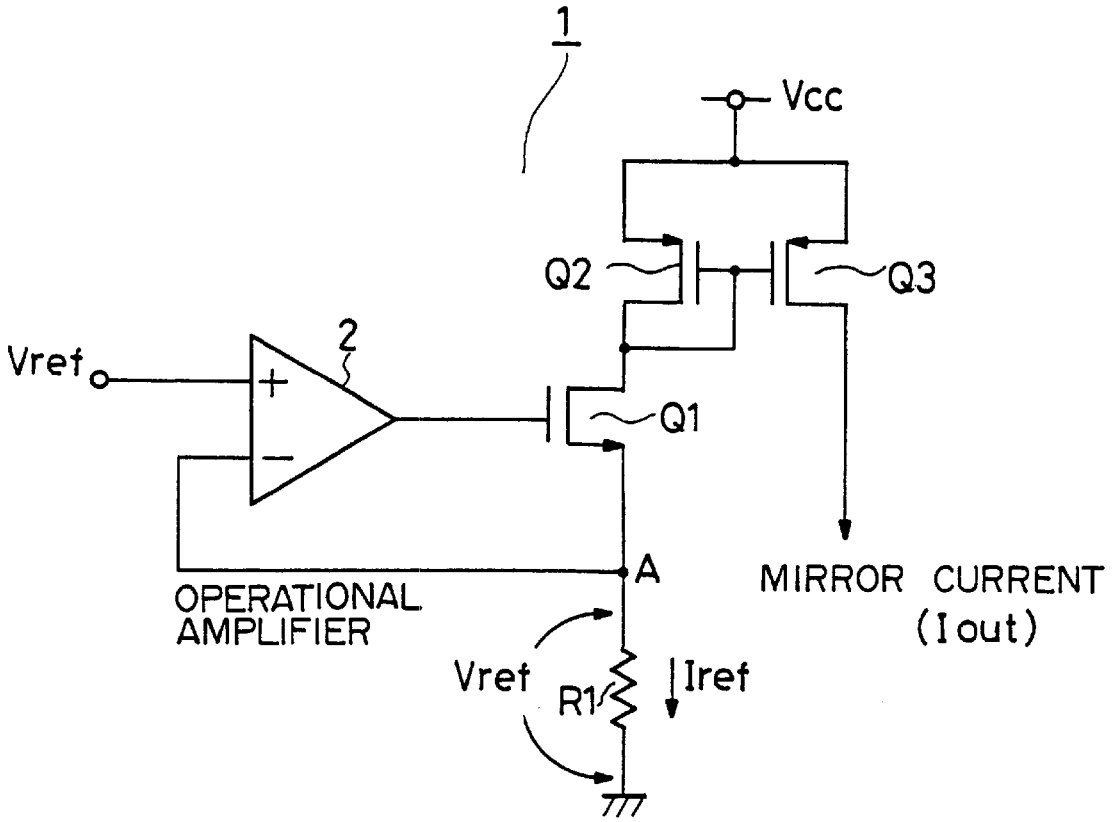
FIG. 1 is a conventional circuit diagram of a current source circuit.
Figure 2:
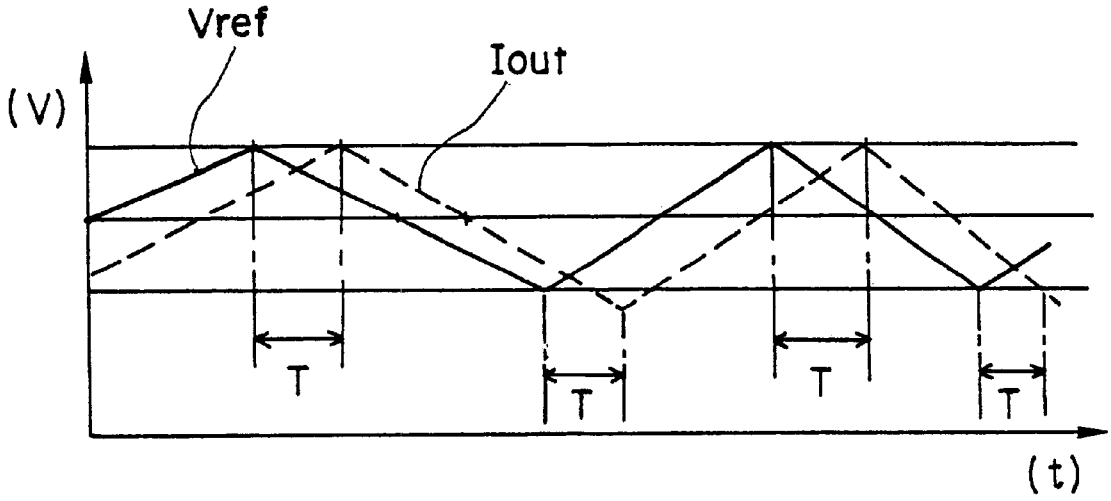
FIG. 2 shows a conventional time lag between a reference signal (Vref) and an output current (mirror current) Iout.

When the circuit configuration of this preferred embodiment is compared with that shown in FIG. 1, the resistor R2 corresponds to the resistor R1 shown in FIG. 1, the MOS transistors Q4 and Q8 correspond to MOS transistors Q2 and Q1, respectively, and the MOS transistor Q7 that outputs output current (mirror current) Iout corresponds to the current flowing in the MOS transistor Q3 shown in FIG. 1. Therefore, the remaining circuit (circuit enclosed with a dotted line in FIG. 3) is adopted instead of the operational amplifier 2 shown in FIG. 1 in this example.

The circuit operation in a current source circuit with the circuit configuration described above is described below.

First, a start signal (Istart) is supplied to the gate (G) of the MOS transistor Q8. Since this start signal (Istart) is sufficient to turn the MOS transistor Q8 on, the MOS transistor Q8 is turned on and outputs gate signals to the gates (G) of the MOS transistors Q4–Q7.

The MOS transistors Q4–Q7 are turned on by these gate signals, and then current flows in the MOS transistor Q9 via the MOS transistor Q5. Therefore, after that time the gate (G) of the MOS transistor Q8 is supplied with a gate voltage, and after the circuit starts, the supply of the start signal (Istart) is stopped.

In this way, the circuit in this example starts operation, current that flows in the MOS transistors Q4 and Q8 flows in the resistor R2, and the current that flows in the resistor R2 becomes a reference current (Iref) based on the reference signal (Vref). In this case, the same current flows in the MOS transistor Q9 via the MOS transistor Q5, and the source (S) of the MOS transistor Q9 is controlled by the reference signal (Vref).

Specifically, the MOS transistors Q8 and Q9 compose a current mirror circuit, the potential at point A and that at point B shown in FIG. 3 become the same and the potential at point B is based on the reference signal (Vref). Therefore, the reference current (Iref) is determined by dividing the voltage of the reference signal (Vref) by the resistance value of the resistor R2.

Therefore, the reference current (Iref) varies based on the variation of the reference signal (Vref). Specifically, the current varies in the same way as the reference signal (Vref) varies. This reference current (Iref) is the same as the output current (mirror current) Iout generated in the first current mirror circuit. Therefore, output current (mirror current) Iout corresponding to the variation of the reference signal (Vref) can be obtained.

Furthermore, in this example, the reference signal (Vref) can be supplied to point A shown in FIG. 3 without the use of both an operational amplifier and a feedback circuit. Therefore, the output current (mirror current) Iout can be obtained in real time according to the variation of the reference signal (Vref), and thereby there is no conventional time lag.

There is no current in the reference signal (Vref) supply circuit 3 that supplies the reference signal to point A. Specifically, the same mirror current flows in the MOS transistors Q10 and Q11 that compose the third current mirror circuit, and the same mirror current also flows in the MOS transistors Q5 and Q6 that compose the first current mirror circuit. Therefore, there is no current in the reference signal (Vref) supply circuit 3.

According to the current source circuit in this example, since there is no delay in the output current (mirror current) Iout, a pulse signal with a desired waveform can be obtained without fail. Therefore, for example, if this signal is used in an oscillator modulation, an accurate frequency module with a desired voltage value can be obtained.

Although in the above description it is assumed that the reference signal (Vref) is a triangular wave, the signal is not limited to a triangular wave, and a variety of signals, such as a rectangular wave, a sine wave, etc., are applicable.

Furthermore, the configuration of a current mirror circuit is also not limited to that shown in FIG. 3.

In this way, according to the present invention, the output current (mirror current) can be obtained without delay.

Accordingly, an accurate desired signal can be generated by using output current (mirror current) without delay.

Since a current source circuit can be implemented without the use of an operational amplifier, the circuit can be miniaturized and thereby circuit design flexibility can also be improved.

What is claimed is:

1. A current source circuit for minimizing the time lag between a reference signal and an output current, the current source circuit comprising:

a first current mirror circuit for outputting the output current;

a second current mirror circuit connected to the first current mirror circuit, and the second current mirror circuit connected to a resistor for generating a reference current corresponding to the output current;

a reference signal supply circuit for supplying the reference signal to the second current mirror circuit, wherein the reference signal supplies current for generating the reference current; and an input terminal connected to at least one of the first current mirror circuit and the second current mirror circuit and the input terminal receives a start signal that drives one of the first current mirror circuit and the second current mirror circuit.

2. The current source circuit of claim 1 further comprising:

a third current mirror circuit that prevents current from flowing from the second current mirror circuit to the reference signal.

3. The current source circuit of claim 2, wherein the reference signal is a predetermined waveform.

4. The current source circuit of claim 3 wherein the predetermined waveform is a triangular wave.

5. The current source circuit of claim 4 wherein the predetermined waveform is a sine wave.

* * * * *